US007892119B2

(12) United States Patent
Marshall

(10) Patent No.: US 7,892,119 B2
(45) Date of Patent: Feb. 22, 2011

(54) FLETCHING SYSTEM AND METHOD THEREFOR

(76) Inventor: John Marshall, 1193 Bay Ct., Destin, FL (US) 32541

( * ) Notice: Subject to any disclaimer, the term of this patent is extended or adjusted under 35 U.S.C. 154(b) by 294 days.

(21) Appl. No.: 11/805,590

(22) Filed: May 24, 2007

(65) Prior Publication Data

US 2008/0176683 A1 Jul. 24, 2008

Related U.S. Application Data

(63) Continuation-in-part of application No. 11/657,676, filed on Jan. 24, 2007.

(51) Int. Cl.
*F42B 6/06* (2006.01)

(52) U.S. Cl. ..... 473/586

(58) Field of Classification Search ..... 403/381; 473/578, 585, 586

See application file for complete search history.

(56) References Cited

U.S. PATENT DOCUMENTS

| | | | | |
|---|---|---|---|---|
| 113,835 | A * | 4/1871 | Barton | 403/381 |
| 119,815 | A * | 10/1871 | Brintzinghoffer | 15/145 |
| 509,364 | A * | 11/1893 | Coffeen | 403/381 |
| 1,130,324 | A * | 3/1915 | Owen | 446/127 |
| 4,114,884 | A * | 9/1978 | Tunnicliffe | 473/586 |
| 4,534,568 | A | 8/1985 | Tone | |
| 4,886,280 | A * | 12/1989 | Bottelsen | 473/586 |
| 5,427,385 | A | 6/1995 | Conrad et al. | |
| 5,443,273 | A | 8/1995 | Lovorn | |
| 5,987,724 | A | 11/1999 | Kleman | |
| 6,478,700 | B2 | 11/2002 | Hartman | |
| 6,695,727 | B1 | 2/2004 | Kuhn | |
| 7,074,143 | B2 | 7/2006 | Czemske et al. | |
| 2006/0258491 | A1 | 11/2006 | Walsh | |

OTHER PUBLICATIONS

U.S. Appl. No. 11/657,676, filed Jan. 24, 2007, Marshall.

* cited by examiner

*Primary Examiner*—John Ricci
(74) *Attorney, Agent, or Firm*—Woodcock Washburn LLP

(57) ABSTRACT

A fletching system and method that allows for quick and easy attachment of a fletching member to an arrow shaft provides a slotted arrow shaft adapted to receive a fletching member projecting therethrough and an internal plug member disposed within a hollow center of the arrow shaft in pressing frictional fit engagement with a flanged base portion of the fletching member wherein the flanged base portion is secured between the plug member and an internal surface of a sidewall of the arrow shaft.

20 Claims, 6 Drawing Sheets

751
750
751
752
739
753
732
737
730
125
120
120a
120b
121
734
737
710b
712
739
731
700
732
L
716
730
W
733
711
715
710a
710
714
740
745
743
740

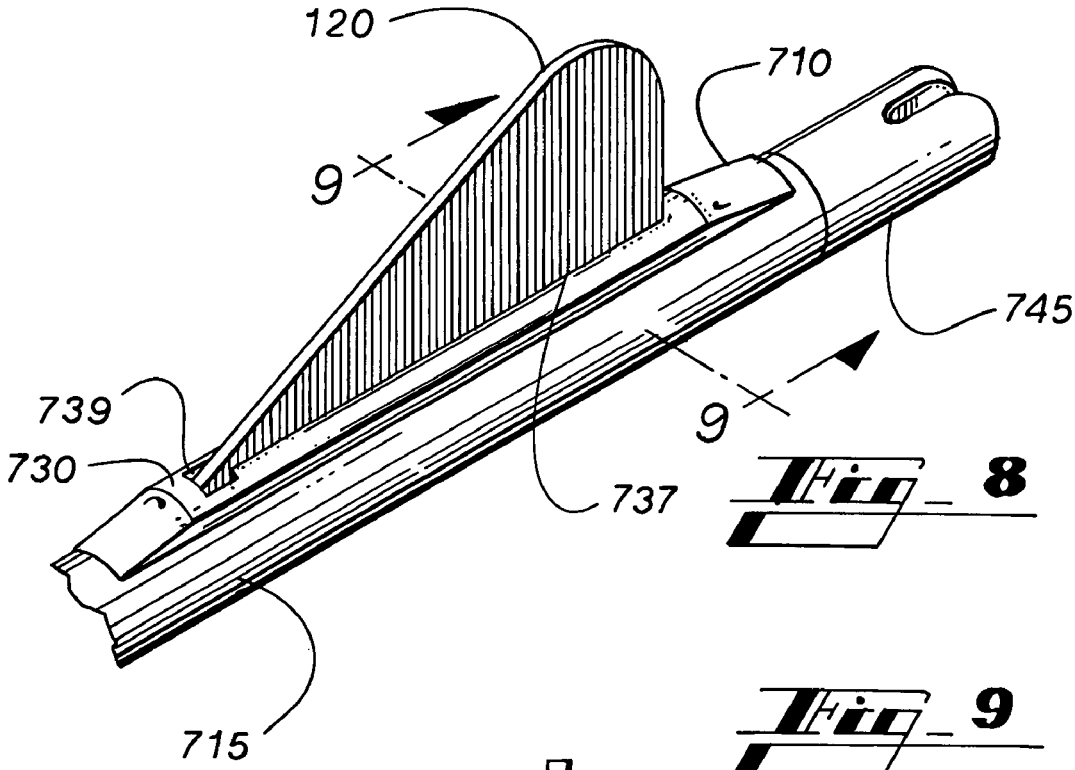
Fig. 8
Fig. 9
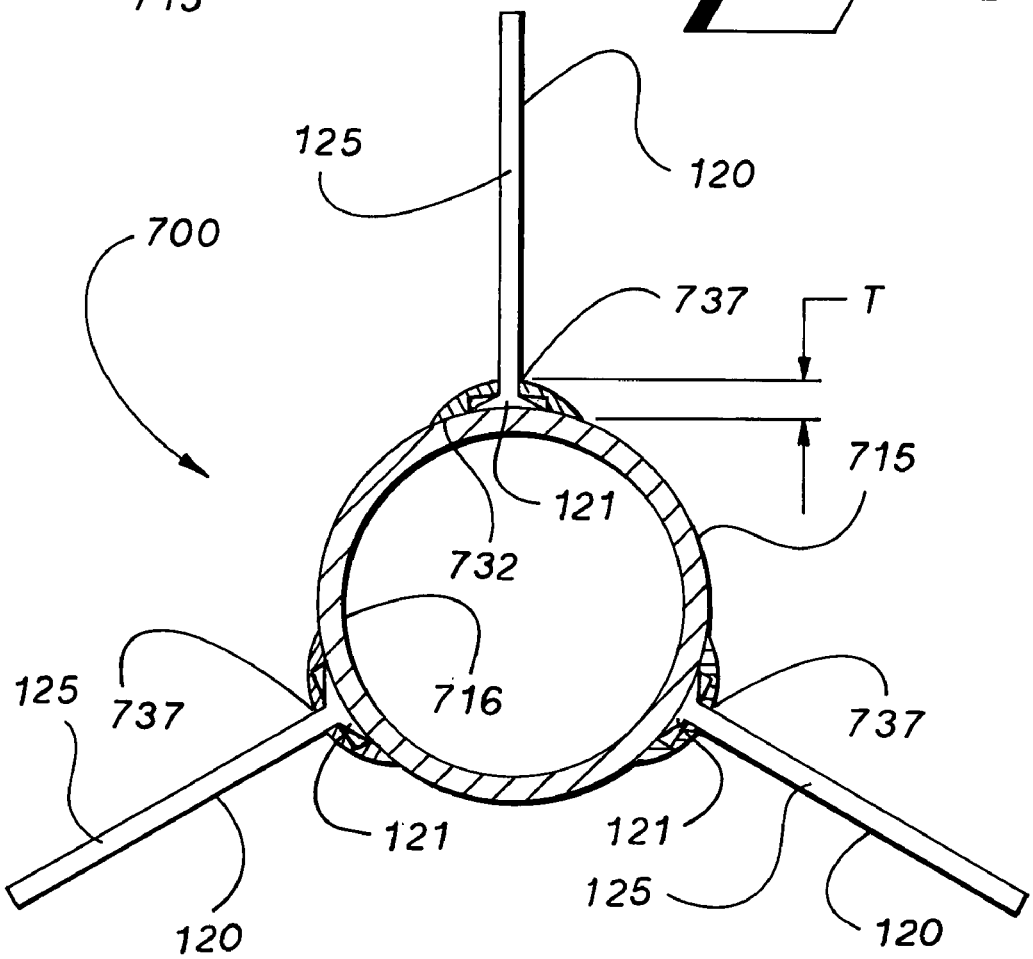

FLETCHING SYSTEM AND METHOD THEREFOR

RELATED APPLICATION

The present United States Non-provisional Utility Patent Application is a continuation-in-part of, and hereby claims priority to, and the full benefit of, United States Non-provisional Utility Patent Application having assigned Ser. No. 11/657,676, filed on Jan. 24, 2007, on behalf of John Marshall, entitled "Fletching System and Method Therefor", incorporated herein by reference.

TECHNICAL FIELD

The present invention relates generally to archery, and more specifically, to a fletching system and method.

BACKGROUND OF THE INVENTION

Bows and arrows have long been used in many various fields of endeavor, such as combat, hunting, sport, competition, and recreation. In almost all instances, accuracy is critical in achieving a successful shot. Most notably, flight characteristics of the arrow play a large role in determining the accuracy of the shot. In order to adjust the flight characteristics of an arrow, one or more fletching member is typically provided on the shaft of an arrow. The design and attachment of the fletching members affect drag, spin, and trueness of flight, in addition to other flight characteristics.

Typically, fletching members are attached to the outside of an arrow shaft using an adhesive. Correct alignment and positioning of the fletching members during attachment is usually attempted by using a fletching jig that retains the fletching members in the proper position while the adhesive cures. Unfortunately, the process of applying the fletching members using conventional jigs is tedious, difficult, time-consuming, and does not ensure accurate results. For example, one or more fletching members may become misaligned, potentially interfering with the proper function of the fletching members.

In addition, the jig is an expensive piece of specialized equipment and can only be used to apply fletching members to a single arrow shaft at a time. Since the jig must remain attached to the arrow shaft until the adhesive cures, fletching techniques using a conventional jig are limited in their efficiency. Thus, fletching using a conventional jig typically takes a long time and is done well in advance of the time when the arrow is to be fired. This means that arrows are typically transported with the fletching members attached, whereby the fletching members may be damaged or become detached from the arrow shaft, thereby necessitating time-consuming repair.

Finally, conventional fletching techniques cannot practically be performed in the field in the event that a fletching member is damaged during use or transportation, due to inconvenience of carrying the jig, as well as the long curing time associated with the use of adhesive. Thus, archers typically carry more "spare" arrows than they would need if fletching member repair could practically be performed in the field.

One attempt to address these problems involved the use of a stamped sheet metal member having flanges punched and bent upwards extending from the surface of the sheet. The device could be glued to the exterior of an arrow shaft for retaining a feather therein. This design, however, had numerous flaws which presumably were the cause of its ultimate failure in the market. One such flaw was the presence of the flanges protruding up, radially away from the arrow shaft, adversely impacting the flight characteristics of an arrow to which they were attached. Furthermore, because the device was a punched sheet, the feather is forcibly separated from the surface of the arrow shaft, with the sheet metal member therebetween, whereby more the base of the feather itself was exposed to oncoming air, further disturbing the flight characteristics of the arrow. Another disadvantage was the necessary inclusion of structural supports bridging the space between opposing flanges, whereby the flanges could not engage an entire periphery of the feather's base, leaving the feather loose, such that the feather did not provide the desired beneficial effects on the arrow's flight characteristics. Finally, since the design could not provide support and retention of the feather around its entire base, a tab extending radially from the device was necessary to retain the feather engaged with the flanges during use; wherein such tab again further impacted airflow about the feather, and wherein without such tab the feather would simply fall off the arrow in flight or during firing.

It is readily apparent from the flaws of such previous attempts to provide convenient fletching member mounting structures and methods that any projection from the surface of the arrow has the potential to disrupt the flight characteristics thereof, and furthermore is exposed to a great risk of damage by striking an object, and being damaged thereby, during use.

It is desirable, therefore, to provide a fletching system, and a method therefor, that ensures proper alignment of the fletching members, is inexpensive, efficient, and easy to use, thereby reducing the time and cost needed to apply fletching members to an arrow shaft, that allows fletching members to be attached to an arrow shaft in the field, such as during a repair, thereby reducing the number of "spare" arrows that an archer needs to purchase, prepare, and carry, that maintains or improves the flight characteristics of the arrow, and that is protected from exposure to damage during use.

BRIEF SUMMARY OF THE INVENTION

Briefly described, in a preferred embodiment, the present invention overcomes the above-mentioned disadvantages and meets the recognized need for such a system and method therefor by providing a slot formed in an exterior surface of an arrow shaft for removably receiving a fletching member or vane, whereby the fletching member may be inserted into the slot and retained therein for use. The fletching member may be removed from the slot for storage of the arrow, if the fletching member becomes damaged or worn, or if removal or exchange of the fletching member is desired for any other reason. The slot is preferably formed through a pod that is attached to an exterior surface of an arrow shaft, such as by adhesive, whereby the exterior surface of the pod mates with and smoothly transitions to the exterior surface of the arrow shaft, effectively becoming an extension thereof. Such attachment preferably forms a cavity between an exterior surface of the arrow shaft underneath the pod and a seat formed in the bottom surface of the pod, and in which the fletching member is held during use. One or more pods may preferably be attached at desired locations on the arrow shaft to receive one or more respective fletching member.

According to its major aspects and broadly stated, the present invention in its preferred form is a system comprising an arrow shaft, a pod having at least one slot formed therethrough, and a fletching member having a flanged base.

More specifically, the slot of the pod is preferably disposed proximate the seat such that access to the cavity formed thereby is preferably provided by the slot. The seat is preferably defined by a recess formed in a first central portion of the bottom surface of the pod. The first portion is preferably surrounded by a second conformal portion that conforms to the exterior surface of the arrow. Adhesive may preferably be applied to the second conformal portion of the bottom surface for attaching the pod to the arrow shaft. Thus, attaching the second conformal portion of the bottom surface of the pod to the arrow shaft preferably creates a generally enclosed cavity or space proximate the slot, between an exterior surface of the arrow shaft beneath the pod and the first portion, i.e. the seat, of the bottom surface of the pod.

The pod is preferably attached to the arrow shaft in a location where a fletching member will be attached, such as proximate a back end of the arrow shaft. Because the slot through the pod will later hold the fletching member therein, the pod should be attached to the arrow shaft to yield arrangement and placement of the slot in a desired location and configuration. For example, if three fletching members will be disposed about the arrow shaft, then three pods should be attached to the arrow shaft, such as substantially evenly spaced thereabout, and at substantially equal distances from the ends of the shaft. If desired, the pods may be attached such that the slots are angularly disposed with respect to the arrow shaft, at least to a small degree, such that a fletching member installed therein will tend to impart spin to the arrow.

The slot is preferably defined by a continuous peripheral wall that encircles the slot. Thus, the slot has a length defined by a distance between a front portion of the peripheral wall in front of the slot and between the side portions thereof and a back portion of the peripheral wall in back of the slot and between the side portions thereof. The length of the slot is preferably approximately equal to the length of a fletching member to be disposed therein such that axial movement of a fletching member disposed within the slot along the length thereof is reduced or prevented by a physical abutting interaction of a respective front or back end of the fletching member with the front or back portion of the peripheral wall.

Furthermore, a width of the slot, defined between opposing portions of the side portions of the peripheral wall, is preferably approximately equal to a thickness of the fletching member, such that the fletching member is generally retained within the slot, at least in part, by friction fit. Additionally, the slot preferably has a wider portion disposed at a first end thereof, such as at an end of the slot proximate a front of the arrow and proximate the front portion of the peripheral wall. The wider portion preferably allows the flanged base of the fletching member to pass therethrough, such that the fletching member may be installed with the flanged base disposed within the cavity, engaging the seat and the arrow, and with at least a portion of the fletching member projecting from the cavity through the slot. The flanged base is thus retained between the exterior surface of the arrow shaft, under the pod and the seat.

The pod preferably tapers to a reduced, preferably approximately zero, thickness at exterior peripheral portions thereof. Such taper or reduced thickness area around a peripheral edge of the pod facilitates a smooth transition between an exterior surface of the arrow shaft and the exterior surface of the pod, whereby the flight characteristics of the arrow are only slightly effected, if at all, and are preferably improved thereby. The transition between the reduced thickness peripheral edge and the full thickness areas of the pod, such as those areas proximate the slot, preferably also serves to deflect any impact force that might otherwise be transferred to the pod, whereby damage thereto may be avoided. As such, the exterior surface of the pod may be seen as an extension of the exterior surface of the arrow shaft, albeit at an area of increased diameter.

Insertion of the fletching member into the slot is preferably performed by inserting a first end of the fletching member, such as a back end, into the wider portion of the slot, with the body of the fletching member extending generally perpendicularly from the exterior surface of the arrow shaft. The first end of the fletching member is then preferably slidably fed toward the second end of the slot. Preferably, when the first end of the fletching member reaches the second end of the slot, the entire flanged base is disposed within the seat, below the upper surface of the pod, and is retained therein, such as by friction fit and/or by mechanical abutting relationship with the peripheral wall of the slot and/or the seat.

Removal of the fletching member from the slot is preferably accomplished by pulling the flanged base upward and outward through the wider portion of the slot until it reaches, an area above the upper surface of the pod, and then sliding the first end of the fletching member toward the first end of the slot. When the first end of the flanged base of the fletching member reaches the wider portion of the slot, the fletching member is then preferably removed completely from the slot.

Accordingly, a feature and advantage of the present invention is its ability to allow one or more fletching member to be attached to an arrow shaft quickly and accurately, such that replacement or installation of the fletching member can easily be accomplished in the field without the use of any tools.

Another feature and advantage of the present invention is its ability to allow arrows to be stored and transported with the fletching members detached, whereby damage to the fletching members may be avoided, and whereby the space needed for storage of the arrow may be reduced.

Another feature and advantage of the present invention is its ability to allow use of conventional fletching members in the system, whereby a user's existing supply of fletching members may be used, and whereby compatible fletching members are readily available.

Another feature and advantage of the present invention is its ability to provide a fletching member attachment device that is attached to an exterior of an arrow shaft that does not adversely interfere with the flight characteristics of the arrow, and which reduces or avoids damage thereto from contact with foreign objects during use, such as the landscape or a target.

Another feature and advantage of the present invention is its ability to securely retain a fletching member in an attachment device by preventing relative motion therebetween through abutting physical interaction.

These and other objects, features, and advantages of the invention will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the Preferred Embodiment referring thereto, in which like reference numbers throughout the various Figures designate like structure and in which:

FIG. 1 is an exploded perspective view of the components of the fletching system of the present invention according to a first embodiment;

FIG. 8 is a perspective view of the assembled components of the preferred embodiment;

FIG. 9 is a bottom view of a pod member of the present invention;

Figure 2:
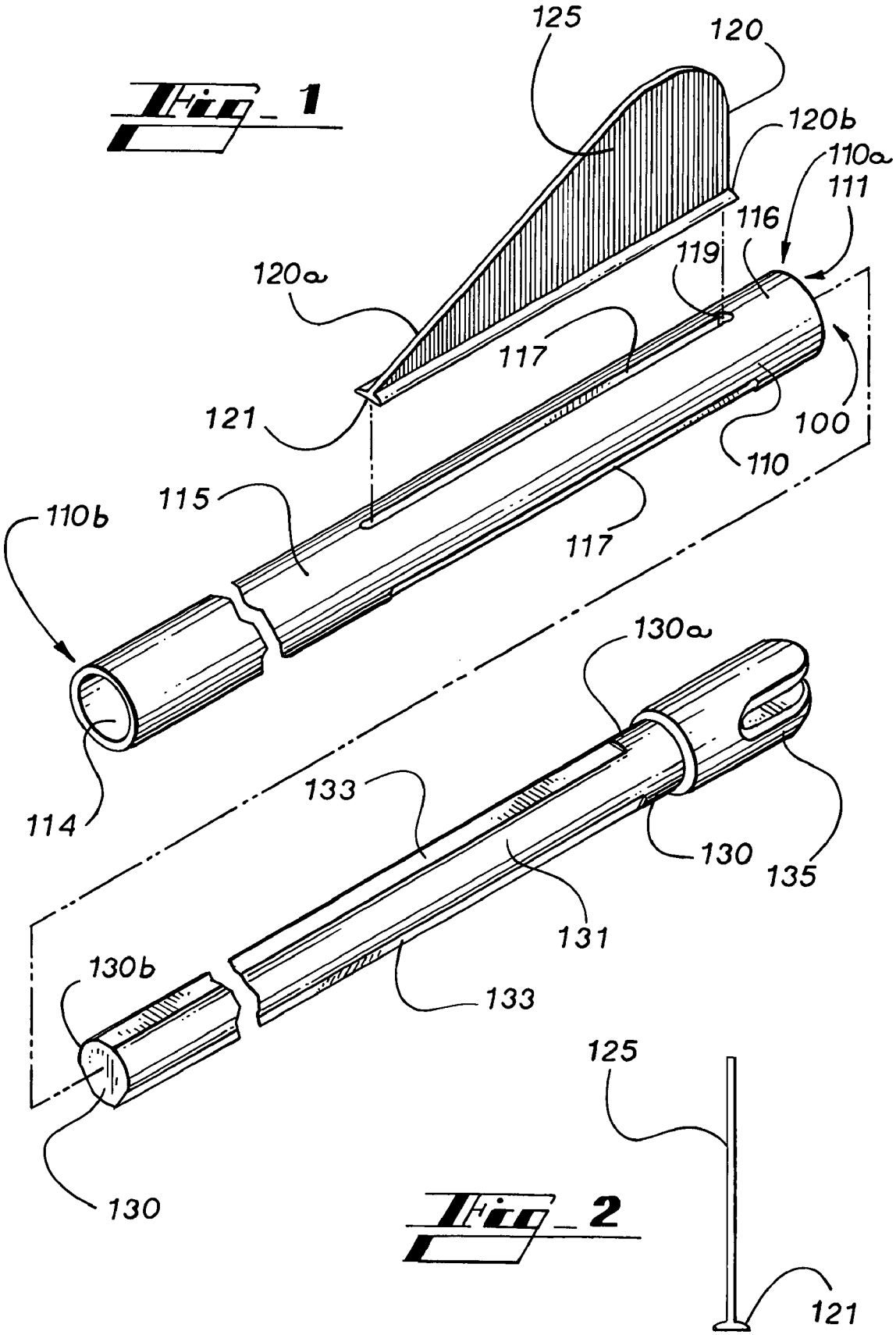
FIG. 2 is a cross-sectional view of the fletching member of a preferred embodiment of the present invention.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

In that form of the preferred embodiment of the present invention chosen for purposes of illustration, FIG. 1 shows fletching system 100, preferably including arrow shaft 110, at least one fletching member 120, and plug member 130. Arrow shaft 110 preferably comprises an archery arrow shaft generally formed as a hollow circular cylinder. Arrow shaft 110 is preferably formed from aluminum, carbon, or a combination thereof, although arrow shaft 110 may be formed of wood, plastic, graphite, composite, or other suitable material or combinations thereof.

Arrow shaft 110 preferably comprises hollow center 111 disposed along at least a portion of the length of arrow shaft 110 from first end 110*a* to second end 110*b*, preferably proximate first end 110*a* for receiving plug member 130. Hollow center 111 is preferably defined by side wall 115, is preferably open to an outside environment of arrow shaft 110 at first end 110*a*, and preferably extends along the length of arrow shaft 110 toward second end 110*b* at least as far as slot 117. Thus, hollow center 111 preferably allows plug member 130 to be inserted into first end 110*a* and completely underlie slot 117 from within hollow center 111.

Slot 117 is preferably formed radially completely through side wall 115 and preferably extends in a straight line generally axially along the length of arrow shaft 110. Slot 117 may, alternatively, be formed in a curved arrangement, such as spiral or helical. Slot 117 preferably defines a closed periphery, i.e. slot 117 preferably does not extend to either end of arrow shaft 110, thereby allowing fletching member 120 to be completely encircled thereby and retained therein. Slot 117 is preferably formed in arrow shaft 110 by a machining technique, such as CNC routering, but may alternatively be formed by other manufacturing technique, or may be integrally formed with arrow shaft 110 such as during a molding or extrusion process. Slot 117 preferably includes wider portion 119, preferably disposed at an end of slot 117 proximate first end 110*a*, for receiving flanged base 121 of fletching member 120 as described in more detail hereinbelow.

Fletching member 120 preferably comprises a generally T-shape cross section (as best seen in FIG. 2) comprising flanged base 121 and flight control element 125 generally centered thereon and extending generally perpendicular thereto. Alternatively, however, fletching member 120 may comprise other cross-sectional shapes, so long as the base portion has a width preferably greater than a width of flight control element 125, and preferably greater than a width of at least a portion of slot 117. Flanged base 121 preferably provides a means for attaching flight control element 125 to arrow shaft 110 such that flight control element 125 projects generally perpendicular to exterior surface 116 of arrow shaft 110 in order to give arrow shaft 110 beneficial flight characteristics. Preferably, such means for attachment comprises the base portion having a width greater than a width of at least a portion of slot 117, such that once the base portion is disposed within hollow center 111, the base portion may be retained therein by the configuration of slot 117.

Fletching member 120 is preferably formed from plastic such as by a molding or an extrusion process, and flanged base 121 and flight control element 125 are preferably integrally formed. Alternatively, however, fletching member 120 may be formed of any suitable natural or synthetic material which is sufficiently pliable and resilient to allow fletching member 120 to deform upon contact with a foreign object, thereby avoiding or reducing damage thereto, and allowing fletching member 120 to return to its original shape when not in contact with such foreign object. Furthermore, flanged base 121 and flight control element 125 may alternatively be formed of different materials and may be formed separately and joined using an adhesive or other suitable fastener or joining technique. Preferably, flanged base 121 has a width approximately equal to, or slightly less than, the width of wider portion 119, and flight control element 125 preferably has a thickness approximately equal to, or slightly less than, the width of slot 117. Thus, when flanged base 121 is inserted through wider portion 119 and into hollow center 111, preferably starting at first end 120*a* and continuing along the length of fletching member 120 to second end 120*b*, flight control element 125 preferably protrudes through slot 117 and is in friction fit with side wall 115 due to the tight fit of flight control element 125 within slot 117. When inserted through wider portion 119, flanged base 121 preferably remains proximate to or in contact with interior surface 114 of side wall 115.

Plug member 130 is preferably formed as a generally elongated circular cylinder and preferably includes at least one recess 133, such as a flat, formed generally axially along outer surface 131 thereof. Plug member 130 is preferably configured in size and shape such that it fits within hollow center 111 and such that outer surface 131 is in frictional fit engagement with inner surface 114 of side wall 115 when inserted into arrow shaft 110. Furthermore, plug member 130 preferably includes nock 135 disposed on first end 130*a* thereof. Nock 135 is preferably adapted to engage a bow string of an archery bow for use in shooting arrow shaft 110.

Plug member 130 is preferably formed of plastic or other suitable material that is lightweight and sturdy, such as aluminum, carbon, graphite, titanium, magnesium, composite, or other suitable material, and preferably includes nock 135 integrally formed therewith. Nock 135 preferably has a greater diameter than the rest of plug member 130, and more preferably has a diameter approximately equal to arrow shaft 110 such that nock 135 mates flush with first end 110*a* of arrow shaft 110 when plug member 130 is completely inserted in hollow center 111 through first end 110*a*.

Figure 3:
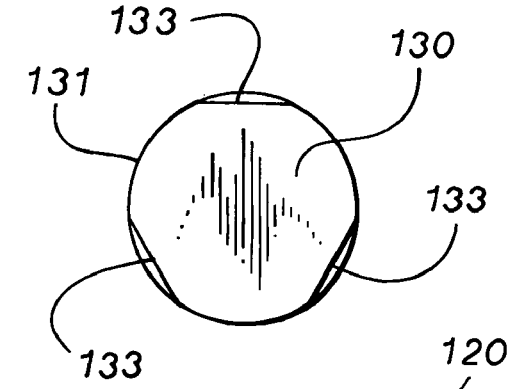
FIG. 3 is a cross-sectional view of the plug member of the first embodiment.
Figure 4:
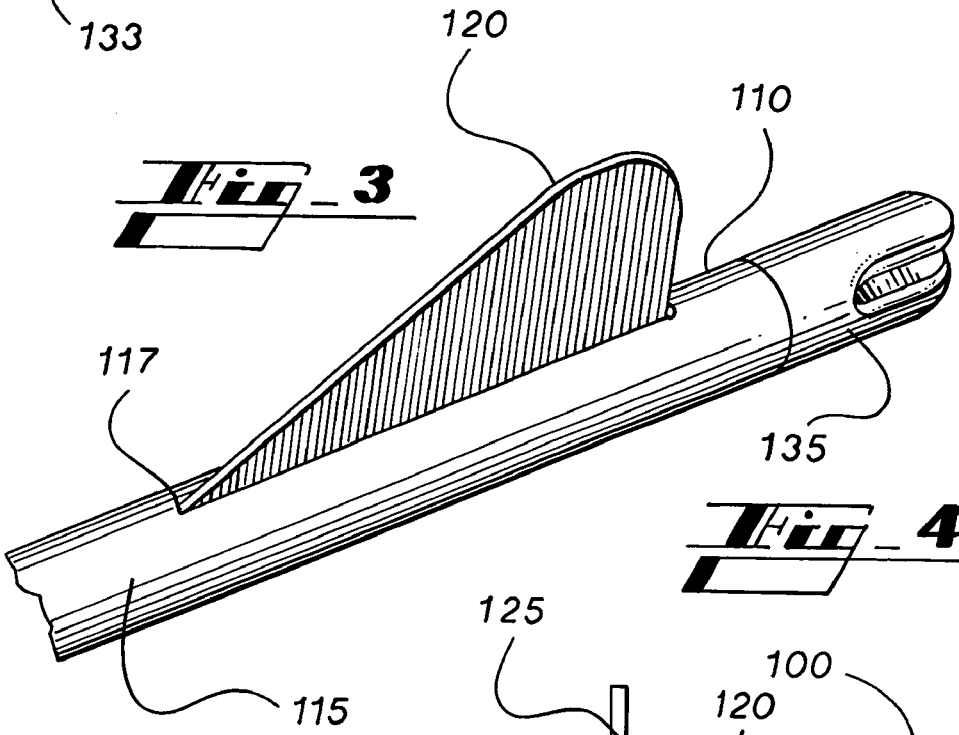
FIG. 4 is a perspective view of the assembled components of the first embodiment.
Figure 5:
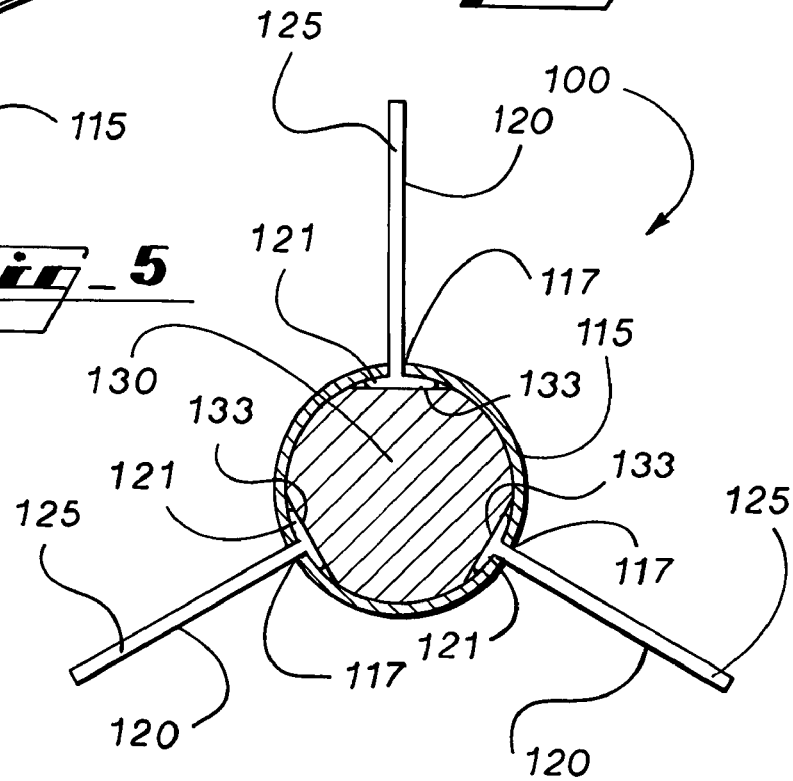
FIG. 5 is a cross-sectional view of the system as shown in FIG. 4.

Preferably, as best shown in FIG. 3, plug member 130 has a number of recesses 130 corresponding to a number of slots 117 formed in arrow shaft 110 and a number of fletching members 120 to be attached to arrow shaft 110. Preferably three fletching members 120 are attached to arrow shaft 110 through three equally-spaced slots 117.

Figure 6A:
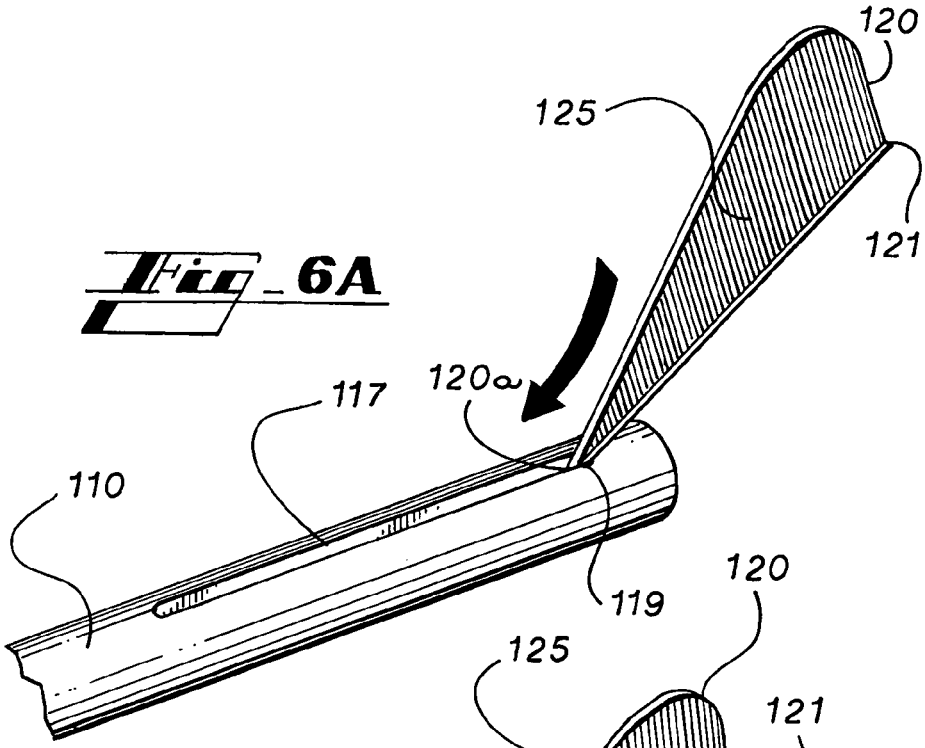
FIGS. 6A-6C are perspective views depicting the insertion of a fletching member into the slot of an arrow shaft according to a first embodiment of the present invention.
Figure 6B:
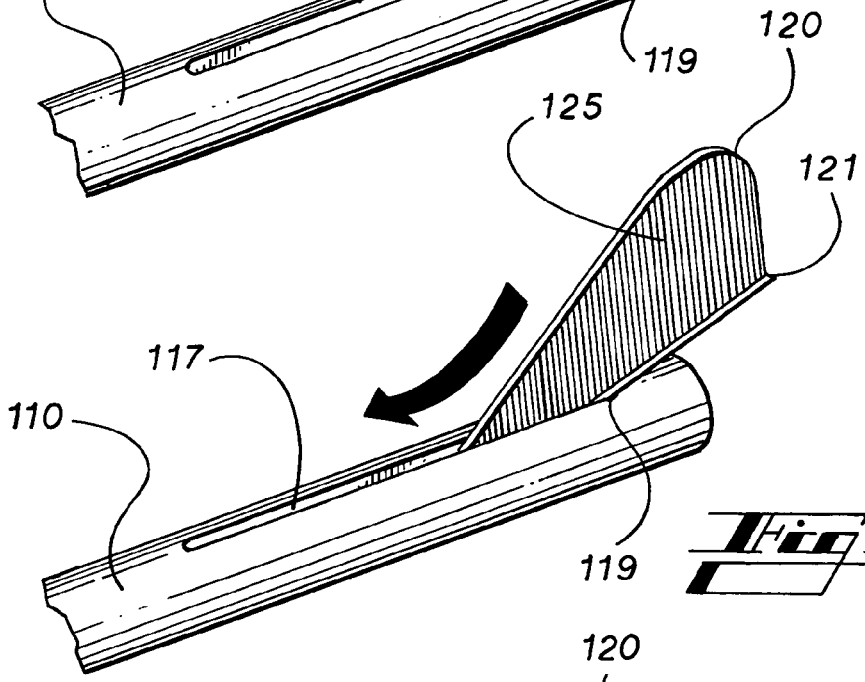
Figure 6C:
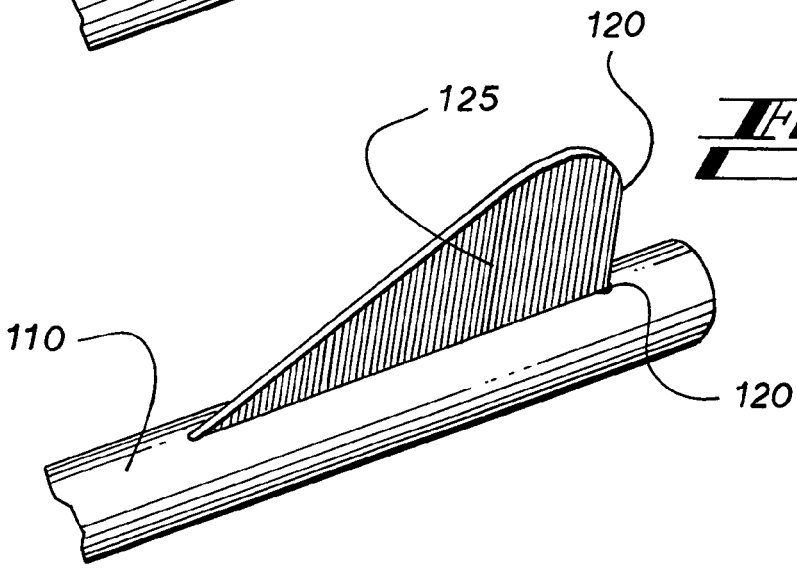
Figures 7, 10:
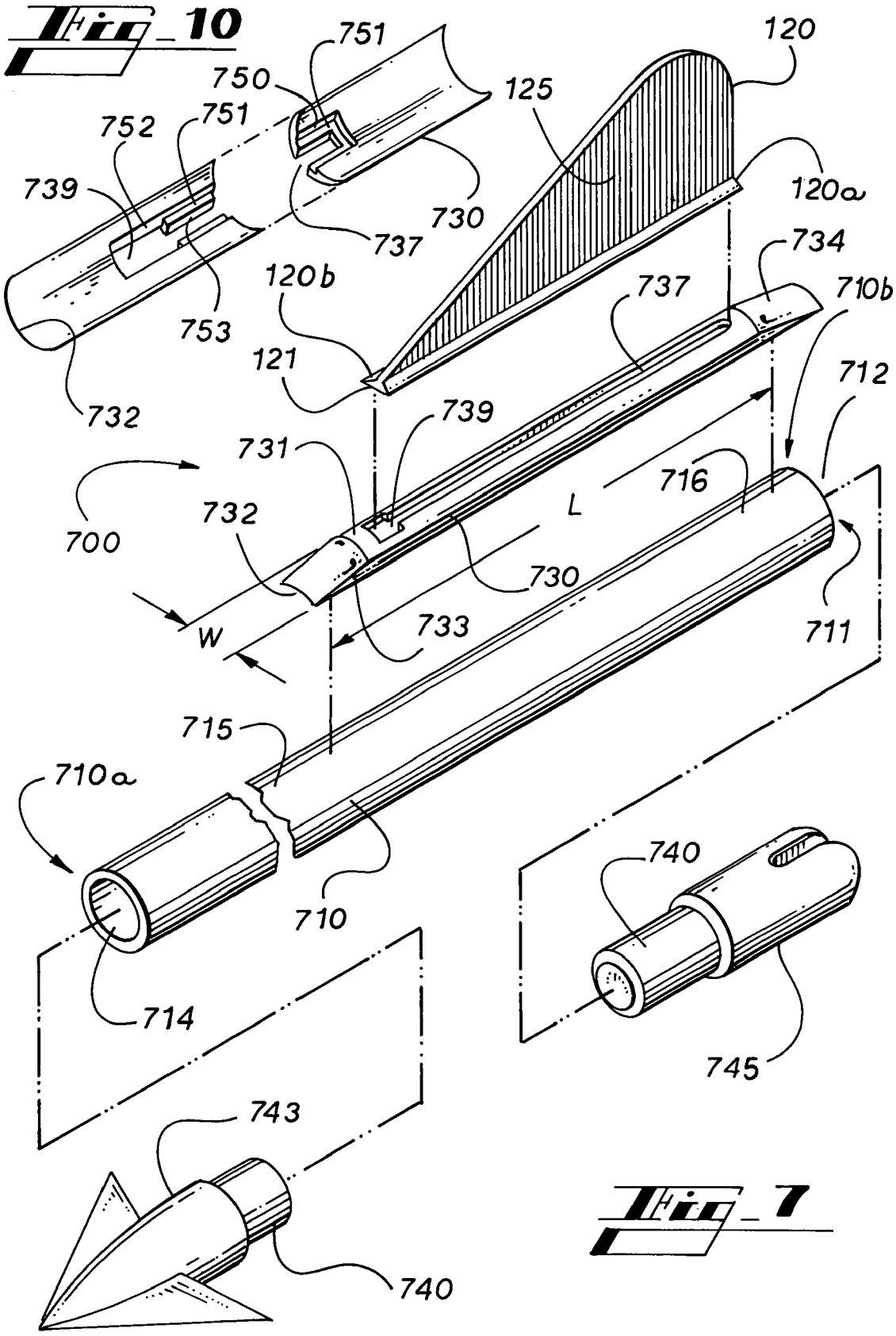
FIG. 7 is an exploded perspective view of the components of the fletching system of the present invention according to a preferred embodiment.
FIG. 10 is a cross-sectional view of the system as shown in FIG. 8.
Figure 11A:
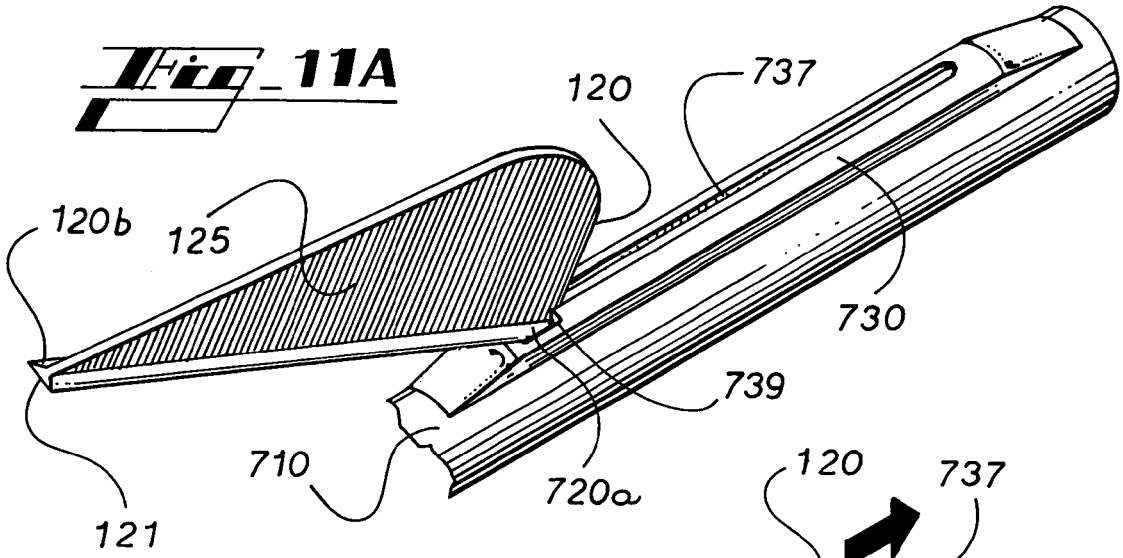
FIGS. 11*a*-11*c* are perspective views depicting the insertion of a fletching member into the slot of an arrow shaft according to a preferred embodiment of the present invention.
Figure 11B:
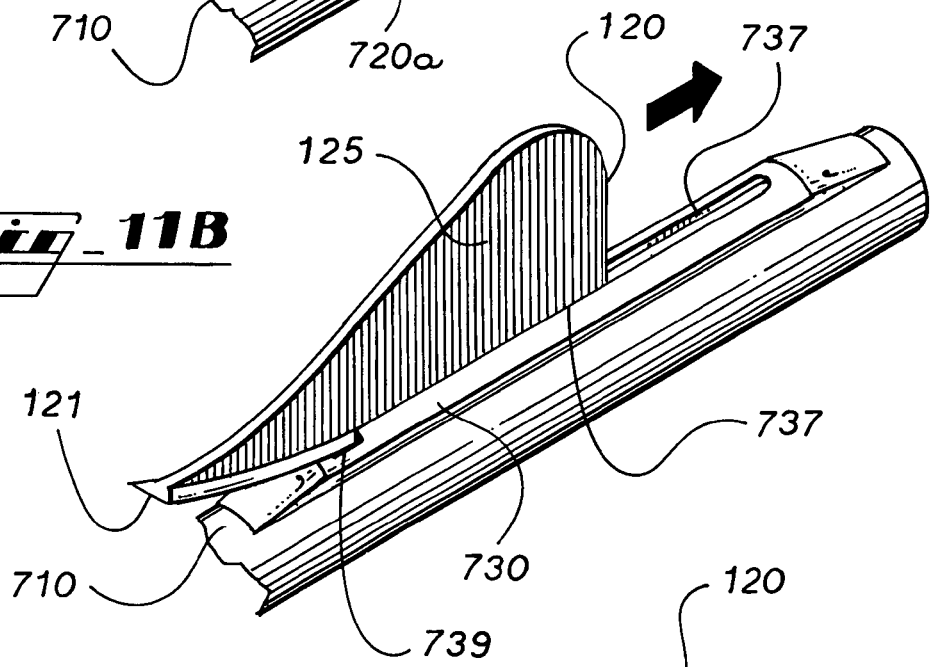
Figure 11C:
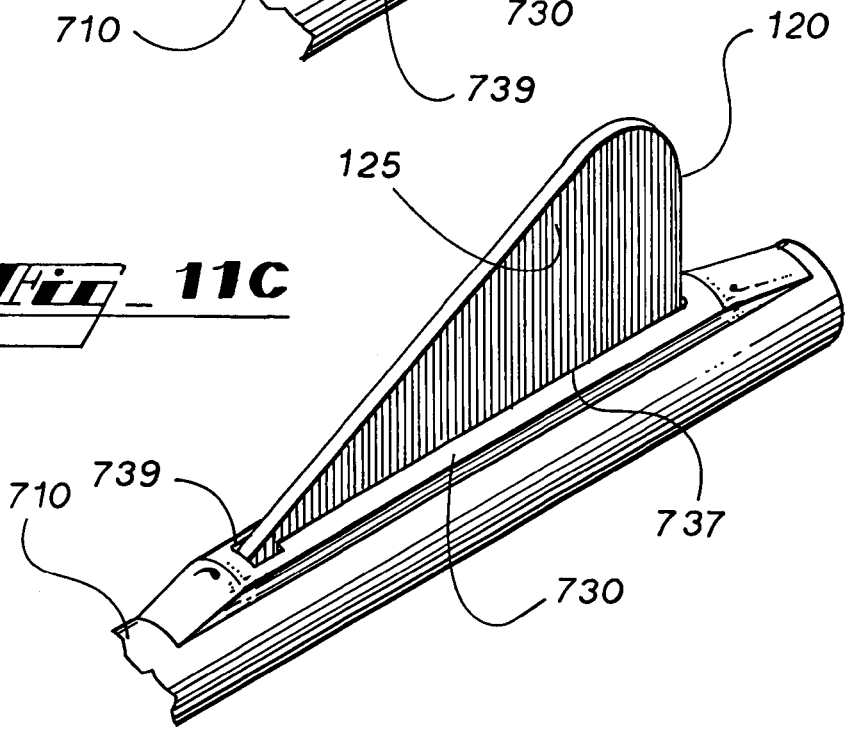

In use, and as illustrated in FIGS. 6A-6C, a portion of flanged base 121 proximate first end 120*a* is preferably inserted through slot 117, preferably at wider portion 119. Fletching member 120 is then preferably slid towards second end 110*b* of arrow shaft 110 such that the rest of flanged base 121 is slid through slot 117, again preferably through wider portion 119. Such sliding insertion of fletching member 120 preferably disposes fletching member 120 projecting through slot 117, with flanged base 121 disposed within hollow center 111. Plug member 130 may then preferably be inserted into hollow center 111 with recess 133 disposed proximate flanged base member 121, thereby allowing for easy insertion of plug member 130. When plug member 130 is fully inserted into hollow center 111, nock 135 preferably abuts first end 110*a*, is flush with exterior surface 116 of sidewall 115, and outer surface 131 of plug member 130 is preferably in frictional fit engagement with interior surface 114 of arrow shaft 110. Preferably, recess 133 of plug member 130 is configured such that flanged base 121 may be retained in pressing fit engagement between recess 133 and internal surface 114 of arrow shaft 110. Optionally, if additional retention force is desired, plug member 130 may be rotated about its central axis within hollow center 111, thereby disposing outer surface 131 in contact with flanged base 121, pinching flanged base 121 between outer surface 131 of plug member 130 and interior surface 114 of arrow shaft 110.

If fletching member 120 becomes damaged or worn, or if a user wishes to remove or replace fletching member 120 for any reason, plug member 130 may preferably be removed from hollow center 111 by pulling it axially out of hollow center 111, preferably by pulling on nock 135. Fletching member 120 may then preferably be removed from slot 117 by sliding flanged base 121 towards first end 110*a*, preferably through wider portion 119, thereby extracting fletching member 120. Alternatively, fletching member 120 may just be pulled radially out of slot 117, whereby flanged base 121 may deform, allowing fletching member 120 to pass through slot 117. Preferably, a new fletching member 120 may then be inserted in slot 117, and retained therein using plug member 130, as described above.

Now referring to FIGS. 7-10, fletching system 700, according to the preferred embodiment, preferably includes arrow shaft 710, at least one fletching member 120, and pod member 730. Arrow shaft 710 preferably comprises an archery arrow shaft, generally formed as a hollow circular cylinder. Arrow shaft 710 is preferably formed from aluminum, carbon, or a combination thereof, although arrow shaft 710 may alternatively be formed of wood, plastic, graphite, combinations thereof, or the like.

Arrow shaft 710 preferably comprises hollow center 711 disposed along at least a portion of the length of arrow shaft 710 from first end 710*a* to second end 710*b*. Hollow center 711 is preferably defined by side wall 715, is preferably open to an outside environment of arrow shaft 710 at least at second end 710*b*, and preferably extends along the length of arrow shaft 710 to first end 710*a*. Thus, hollow center 711 preferably allows plug member 740, such as broad head 743, and/or nock 745, to be inserted into first end 710*a* and second end 710*b*, respectively.

Pod member 730 is preferably formed as a generally thin elongated member having top surface 731, bottom surface 732, first end 733 and second end 734, and is preferably formed of LEXAN or other suitable polycarbonate resin. Pod member 730 may alternatively be formed of another suitable polymer material, such as polypropylene, polyamide, or the like, carbon, graphite, aluminum, magnesium, titanium, wood, or the like. Pod member 730 preferably further has a length L from first end 733 to second end 734, and width W extending generally perpendicular to length L. Furthermore, pod member 730 preferably has a thickness T extending between top surface 731 and bottom surface 732. The thickness T of pod member 730 preferably decreases proximate a peripheral edge thereof, defining transition portions 730*a*, 730*b*, 730*c*, and 730*d* proximate a front, first side, back, and second side thereof, respectively. Transition portions 730*a*, 730*b*, 730*c*, and 730*d* preferably provide a smooth transition between exterior surface 716 of the arrow shaft and top surface 731 of pod member 730. Thus, top surface 731 may preferably be considered an extension of exterior surface 716 of arrow shaft 710.

Thickness T of pod member 730 preferably decreases proximate peripheral portions thereof such that top surface 731 preferably meets exterior surface 716 of arrow shaft 710 at a small angle, thereby forming a smooth transition between exterior surface 716 and top surface 731. Such a smooth transition preferably reduces an effect of pod member 730 on the overall flight characteristics of arrow shaft 710, such as by reducing drag or other noise, and may even be designed so as to improve the flight characteristics of arrow shaft 710, such as by providing stability. To further facilitate such effect on the flight characteristics of arrow shaft 710, one or more of transition portions 730*a*, 730*b*, 730*c*, and 730*d*, such as front transition portion 730*a*, may include streamlined forms, such as a pointy, curved, or v-shaped transition portion 730*a*.

Preferably, a first portion 732*a* of bottom surface 732 is conformal to the shape of exterior surface 716 of arrow shaft 711, i.e. first portion 732*a* of bottom surface 732 is curved in the direction of width W to match a curvature of exterior surface 716 of arrow shaft 711 beneath pod member 730. Preferably, first portion 732*a* of bottom surface 732 is disposed about the peripheral edge of pod member 730, thereby defining a generally centrally disposed second portion 732*b*. Thus, when pod member 730 is disposed on exterior surface 716 of arrow shaft 711, first portion 732*a* of bottom surface 732 mates preferably flush therewith, whereby an adhesive may be applied to first portion 732*a* of bottom surface 732 and exterior surface 716 of arrow shaft 710 to attach pod member 730 to arrow shaft 710. Second portion 732*b* is preferably defined by a recess or cavity in bottom surface 732, thereby forming seat 735, discussed in more detail below.

Slot 737 is preferably formed completely through pod member 730 in the direction of thickness T, and preferably extends in a generally straight line in the direction of length L of pod member 730. Slot 737 may, alternatively, be arranged in a curved configuration, such as spiral or helical, such as by attaching pod member 730 to arrow shaft 710 with length L disposed at an angle to a longitudinal axis 712 of arrow shaft 710. Slot 737 is preferably defined by closed-loop peripheral wall 738, comprising front portion 738*a*, first side portion 738*b*, back portion 738*c*, and second side portion 738*d*. Thus, slot 737 preferably does not extend to either of first end 733 or second end 734 of pod member 730 (and more preferably does not extend into any of transition portions 730*a*, 730*b*, 730*c*, or 730*d*), thereby allowing fletching member 120 to be retained therein by a physically abutting relationship between adjacent portions of peripheral wall 738 and fletching member 120.

Slot 737 is preferably formed in pod member 730 during molding of pod member 730, such as injection molding, but may alternatively be formed by another technique, such as machining or the like. Slot 737 preferably has a width substantially equal to a width of flight control element 125 and preferably includes wider portion 739 for allowing flanged base 121 to pass therethrough as is described in more detail below. Wider portion 739 is preferably formed at an end of slot 737 proximate first end 733 of pod member 730.

Seat 735 is preferably formed in bottom surface 732 proximate slot 737, and preferably defines second portion 732*b* of bottom surface 732 that is preferably not conformal to surface 716 of arrow shaft 710. Seat 735 is preferably generally conformal to flanged base 121, such that when pod member 730 is attached to arrow shaft 710, seat 735 receives flanged base 121 therein, and maintains flanged base 121 in friction-fit engagement with at least one of exterior surface 716 of arrow shaft 710 and the second portion of bottom surface 732 of pod member 730.

The width of flanged base 121 is preferably greater than a width of at least a portion of slot 737 of pod member 730. Thus, flanged base 121 preferably provides a means for attaching flight control element 125 to arrow shaft 710 such that flight control element 125 projects generally perpendicular to exterior surface 716 of arrow shaft 710 in order to give arrow shaft 710 beneficial flight characteristics. Preferably, such means for attachment comprises flanged base 121 having a width greater than a width of at least a portion of slot 737, such that once flanged base 121 is disposed within seat 735 of pod member 730, flanged base 121 may be retained therein by the configuration of slot 737.

Preferably, flanged base 121 has a width approximately equal to, or slightly less than, a width of wider portion 739 of slot 737, and flight control element 125 preferably has a thickness approximately equal to, or slightly less than, the width of slot 737. Thus, when flanged base 121 is inserted through wider portion 739 and into seat 735, preferably starting at first end 120*a* and continuing along the length of fletching member 120 to second end 120*b*, flight control element 125 preferably protrudes through slot 737 and is in friction fit therewith due to the tight fit of flight control element 125 within slot 737. When inserted through wider portion 739, flanged base 121 preferably enters seat 735 and is then in friction fit engagement with at least one of exterior surface 716 of arrow shaft 710 and bottom surface 732 of pod member 730.

In use, and as illustrated in FIGS. 10A-10C, a portion of flanged base 121 proximate first end 120*a* is preferably inserted through slot 737, preferably at wider portion 739. Fletching member 120 is then preferably slid towards second end 110*b* of arrow shaft 110 such that the rest of flanged base 121 is slid through slot 737, again preferably through wider portion 739. Such sliding insertion of fletching member 120 preferably disposes fletching member 120 projecting through slot 737, with flanged base 121 disposed within seat 735. Preferably, exterior surface 716 of arrow shaft 710 and seat 735 are configured such that flanged base 121 may be retained in pressing fit engagement between bottom surface 732 of pod member 730 and exterior surface 716 of arrow shaft 710. The position of wider portion 739 proximate first end 733 of pod member 730 preferably ensures that fletching member 120 will not come dislodged from slot 737 even during acceleration of arrow shaft 710, such as during firing thereof.

If fletching member 120 becomes damaged or worn, or if a user wishes to remove or replace fletching member 120 for any reason, fletching member 120 may preferably be removed from slot 737 by pulling flanged base 121 upward and outward through wider portion 739, and then sliding flanged base 121 towards first end 710*a* of arrow shaft 710, preferably through wider portion 739, thereby extracting fletching member 120. Alternatively, fletching member 120 may just be pulled radially out of slot 737, whereby flanged base 121 may deform sufficiently to allowing fletching member 120 to pass through slot 737. Preferably, a new fletching member 120 may then be inserted in slot 737, and retained therein as described above.

As will be understood by one skilled in the art, the slot of the present invention need not extend entirely through a member in which it is formed, as described in the embodiments presented above. Alternatively, the slot may be formed in a first surface of such a member (i.e. and arrow shaft exterior surface) with a portion of the member remaining below the slot. Thus, the remaining portion may serve the securing function of the plug member of the first embodiment, and of the exterior surface of the arrow shaft beneath the pod member in the second, preferred embodiment, described above. The slot of such an alternative embodiment may be formed, for example, by plunging a router bit into, but not through an arrow shaft, either hollow or solid. Preferably, each of the slot, the wider portion, and a seat for receiving the base of a fletching member may all be formed with a single tool in a single process, such as by plunging a t-shaped cutting tool into the surface of an arrow shaft, thereby forming the wider portion of the slot, and thereafter running the bit along the length of the arrow shaft while the a wider portion of the t-shaped tool remains below the surface of the arrow shaft, such that the remainder of the slot is formed by the narrow central shaft of the cutting tool, while the seat is simultaneously formed thereunder by the wider portion of the t-shaped tool. Reversal of the path of the tool allows for removal thereof without the formation of a second wider portion.

Having, thus, described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

The invention claimed is:

1. A fletching system comprising:

a pod member adapted to be affixed to an arrow shaft, the pod having a slot formed therethrough and a seat formed in a surface thereof proximate said slot, said surface comprising a curvature substantially similar to a curvature of an exterior surface of the arrow shaft.

2. The fletching system of claim 1, wherein said seat is adapted to receive a base of a fletching member.

3. The fletching system of claim 1, wherein said slot comprises a wider portion disposed at a first end thereof.

4. The fletching system of claim 1, wherein said slot is defined by a continuous closed-loop internal peripheral wall of said pod member.

5. The fletching system of claim 4, wherein said continuous closed-loop internal peripheral wall of said pod member is adapted to retain a fletching member therein in abutting physical engagement on all sides of a portion of said fletching member extending through said slot.

6. The fletching system of claim 1, wherein said seat defines a partially enclosed space disposed below, and in communication with, said slot when said pod member is disposed on an exterior surface of an arrow shaft.

7. The fletching system of claim 1, wherein said slot comprises a wider portion disposed at a first end thereof, and wherein a width of said wider portion is approximately equal to a width of a base of a fletching member.

8. The fletching system of claim 7, wherein a width of said slot is approximately equal to a width of a flight control element of said fletching member.

9. The fletching system of claim 1, wherein a length of said slot is approximately equal to a length of a flight control portion of a fletching member.

10. The fletching system of claim 1, wherein a length of said seat is approximately equal to a length of a base of a fletching member.

11. The fletching system of claim 1, further comprising a transition portion proximate an external peripheral edge of said pod member, said transition portion comprising a decreasing thickness toward said external peripheral edge.

12. The fletching system of claim 11, wherein said external peripheral edge and said transition portion comprise a streamlined structure.

13. A fletching system comprising:

a pod member adapted to be affixed to an arrow shaft, the pod member having a slot formed therethrough and a seat formed in a surface thereof proximate said slot, said surface adapted to conform to a curvature of an exterior surface of the arrow shaft, wherein said seat is adapted to receive a base of a fletching member.

14. The fletching system of claim 13, wherein said slot comprises a wider portion disposed at a first end thereof.

15. The fletching system of claim 13, wherein said slot is defined by a continuous closed-loop internal peripheral wall of said pod member.

16. The fletching system of claim 15, wherein said continuous closed-loop internal peripheral wall of said pod member is adapted to retain a fletching member therein in abutting physical engagement on all sides of a portion of said fletching member extending through said slot.

17. The fletching system of claim 13, wherein said seat defines a partially enclosed space disposed below, and in communication with, said slot when said pod member is disposed on an exterior surface of an arrow shaft.

18. The fletching system of claim 13, wherein said slot comprises a wider portion disposed at a first end thereof, and wherein a width of said wider portion is approximately equal to a width of a base of a fletching member.

19. The fletching system of claim 18, wherein a width of said slot is approximately equal to a width of a flight control element of said fletching member, and wherein a length of said slot is approximately equal to a length of a flight control portion of a fletching member.

20. The fletching system of claim 13, further comprising a transition portion proximate an external peripheral edge of said pod member, said transition portion comprising a decreasing thickness toward said external peripheral edge.

* * * * *